US006732539B2

(12) United States Patent
Moon et al.

(10) Patent No.: US 6,732,539 B2
(45) Date of Patent: May 11, 2004

(54) AIR CONDITIONING APPARATUS AND CONTROL METHOD THEREOF

(75) Inventors: Je-Myoung Moon, Suwon (KR); Jong-Youb Kim, Suwon (KR); Dong-Kue Lee, Pyungtak (KR); Il-Yong Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/305,117

(22) Filed: Nov. 27, 2002

(65) Prior Publication Data

US 2003/0230097 A1 Dec. 18, 2003

(30) Foreign Application Priority Data

Jun. 14, 2002 (KR) ..... 10-2002-33222

(51) Int. Cl.[7] ..... F25B 7/00
(52) U.S. Cl. ..... 62/175; 62/228.4
(58) Field of Search ..... 62/175, 228.4, 62/228.5, 510, 197, 199

(56) References Cited

U.S. PATENT DOCUMENTS 4,676,072 A * 6/1987 Higuchi ..... 62/175
4,876,859 A * 10/1989 Kitamoto ..... 62/117
5,050,397 A * 9/1991 Sugiyama et al. ..... 62/175
6,018,957 A * 2/2000 Katra et al. ..... 62/175
6,394,120 B1 5/2002 Wichert
6,401,469 B1 6/2002 Dennis et al.
6,612,121 B2 * 9/2003 Moon et al. ..... 62/175

OTHER PUBLICATIONS

U.S. patent application Ser. No. 10/305,176, filed Nov. 27, 2002, Je–Myoung Moon, et al., Samsung Electronics Co., Ltd.

U.S. patent application Ser. No. 10/305,177, filed Nov. 27, 2002, Je–Myoung Moon, et al., Samsung Electronics Co., Ltd.

* cited by examiner

*Primary Examiner*—Marc Norman
(74) *Attorney, Agent, or Firm*—Staas & Halsey LLP

(57) ABSTRACT

An air conditioning apparatus and control method thereof is provided, in which a pulse width modulation compressor and a two-stage variable-capacity compressor are connected in parallel with each other to control capacities of the two compressors according to indoor air conditioning loads. The air conditioning apparatus is cost-competitive because a capacity supplied by the pulse width modulation compressor is relatively low in cost, and the cost required for manufacturing the compressor is reduced in proportion to the reduced capacity. Accordingly, with the air-conditioning apparatus an effect is obtainable in which a variable-capacity compressor with small capacity and a two-stage variable-capacity compressor with large capacity are controlled as if a large-scale variable-capacity compressor with a same capacity as a total capacity of the two compressors were linearly controlled.

22 Claims, 7 Drawing Sheets

AIR CONDITIONING APPARATUS AND CONTROL METHOD THEREOF

CROSS-REFERENCE TO RELATED APPLICATION

This application claims the benefit of Korean Application No. 2002-33222, filed Jun. 14, 2002, in the Korean Industrial Property Office, the disclosure of which is incorporated herein by reference.

BACKGROUND OF THE INVENTION

1. Field of the Invention

The present invention relates generally to an air conditioning apparatus and control method thereof, which has a pulse with modulation compressor and a two-stage variable-capacity compressor.

2. Description of the Related Art

Generally, a single air conditioning apparatus in which one indoor unit is connected to one outdoor unit does not have a large indoor air conditioning load (required capacity), so a fixed-capacity compressor is installed in the outdoor unit.

On the contrary, a multi-unit air conditioning apparatus in which a plurality of indoor units are connected to one outdoor unit is designed such that each of the indoor units independently copes with an air conditioning load of a corresponding indoor space. In such a multi-unit air conditioning apparatus, since air conditioning loads of respect indoor units are different and vary at any time, a variable-capacity compressor is installed in an outdoor unit, and a flow of refrigerant is controlled by ascertaining loads and operating states using communication between each of the indoor units and the outdoor unit. Further, the variable-capacity compressor is controlled by a microcomputer of the outdoor unit. The outdoor unit microcomputer checks the air conditioning requirements with respect to a corresponding indoor space, a temperature condition of the corresponding indoor space, etc. based on information received from each of the indoor units, and controls a capacity of the compressor according to the checked information.

However, since a conventional multi-unit air conditioning apparatus employs a construction in which a plurality of indoor units are connected to one outdoor unit, a compressor installed in the outdoor unit must be designed to endure a maximum indoor air conditioning load. Further, in order for a compressor to endure the maximum indoor air conditioning load, a significant difficulty arises in the production of the compressor. That is, a plurality of performance tests must be carried out so as to increase the capacity of the compressor.

A high-capacity compressor produced by the above process is problematic in that the high-capacity compressor is very expensive, relative to a conventional compressor.

A manner in which a variable-capacity compressor and a fixed-capacity compressor are mixed to cope with indoor air conditioning loads is used in consideration of the above problem.

As shown in FIG. 1, a variable-capacity compressor 10, which operates at a capacity that is varied according to a frequency of an inverter circuit and a fixed-capacity compressor 20 which operates at a constant capacity are connected in parallel with each other. Further, an outdoor unit microcomputer controls capacities of the variable-capacity compressor 10 and the fixed-capacity compressor 20 according to indoor air conditioning loads (required capacities) received from respective indoor units. Referring to FIG. 2, if the indoor air conditioning loads are 0 to 50%, the outdoor unit microcomputer controls the capacity of the variable-capacity compressor 10. In this case, the microcomputer controls the capacity of the variable-capacity compressor 10 by varying a frequency outputted to the variable-capacity compressor 10 from an inverter circuit within a predetermined range R1 according to the indoor air conditioning loads (required capacities) received from the respect indoor units. Further, if the indoor air conditioning loads are 50 to 100%, the outdoor unit microcomputer controls the capacities of the variable-capacity compressor 10 and the fixed-capacity compressor 20. In this case, the microcomputer copes with an insufficient capacity by controlling the capacity of an inverter-type variable-capacity compressor 10 operated according to frequency of the inverter circuit within a predetermined range R2 after activating the fixed capacity compressor 20.

However, if the conventional air conditioning apparatus is used for facilities such as large buildings, a capacity, which must be provided by a variable-capacity compressor, inevitably becomes large. Further, to produce such a high-capacity compressor as an independent device is difficult and expensive, even though an independent device can be produced, thus causing an economic burden by increasing a price of the compressor.

Therefore, in the multi-unit air conditioning apparatus, a method is required of effectively coping with a large-scale indoor air conditioning load (required capacity). Further, a method of accommodating requirements for the large-scale air conditioning capacity while using a conventional compressor is seriously required.

SUMMARY OF THE INVENTION

Accordingly, an air conditioning apparatus and control method thereof is provided, in which a pulse width modulation compressor and a two-stage variable-capacity compressor are connected in parallel with each other to cope with indoor air conditioning loads, thus realizing the compressors at a low price.

Additional aspects and advantages of the invention will be set forth in part in the description which follows and, in part, will be obvious from the description, or may be learned by practice of the invention.

In order to accomplish the above and other aspects an air conditioning apparatus is provided, comprising a first compressor controlled in a pulse width modulation manner; a second compressor connected in parallel with the first compressor and controlled to operate at one of a minimum capacity and a maximum capacity; and a control unit controlling capacities of the first and second compressors such that a total capacity of the first and second compressors is linearly controlled according to indoor air conditioning loads.

Further, an air conditioning apparatus is provided, comprising a plurality of indoor units; and an outdoor unit connected to the plurality of indoor units comprising a first compressor controlled in a pulse width modulation manner; a second compressor connected in parallel with the first compressor and controlled to operate at one of a minimum capacity and a maximum capacity, and an outdoor control unit controlling the capacities of the first and second compressors such that a total capacity of the first and second compressors is linearly controlled according to indoor air conditioning loads required by the indoor units.

Further, a method of controlling an air conditioning apparatus is provided, the air conditioning apparatus having a plurality of indoor units connected to an outdoor unit comprising a first compressor controlling a capacity of the outdoor unit in a pulse width modulation manner and a second compressor operating at one of a minimum capacity and a maximum capacity, comprising calculating an air conditioning capacity required by corresponding indoor units; and controlling capacities of the first and second compressors such that a total capacity of the first and second compressors is linearly controlled according to the calculated air conditioning capacity, wherein a maximum capacity of the first compressor is equal to the minimum capacity of the second compressor, and the maximum capacity of the second compressor is twice the minimum capacity of the second compressor.

An embodiment of the present invention uses two compressors connected in parallel with each other, and controls capacities of the two compressors similarly to an operation of controlling a capacity of a single large-capacity compressor. One of the compressors is a pulse width modulation compressor which linearly controls the capacity of the pulse width modulation compressor, and another compressor is a two-stage variable-capacity compressor which has a relatively large capacity and operates at two different capacities.

BRIEF DESCRIPTION OF THE DRAWINGS

These and other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
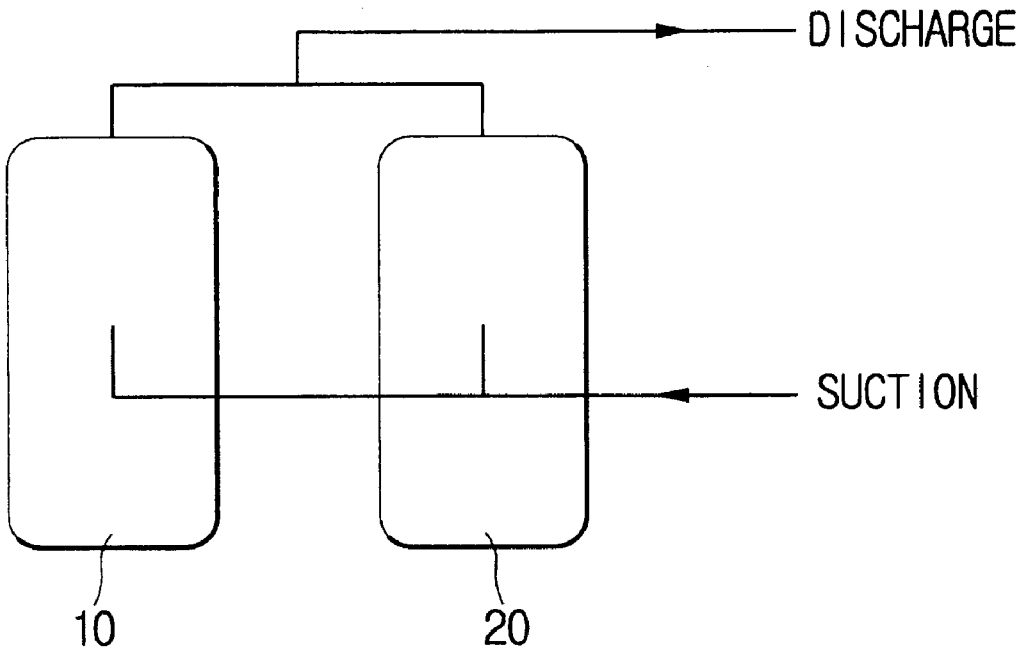
FIG. 1 (PRIOR ART)
FIG. 1 is a view showing a construction of a conventional air conditioning apparatus in which a variable-capacity compressor and a fixed-capacity compressor are connected in parallel with each other.
Figure 2:
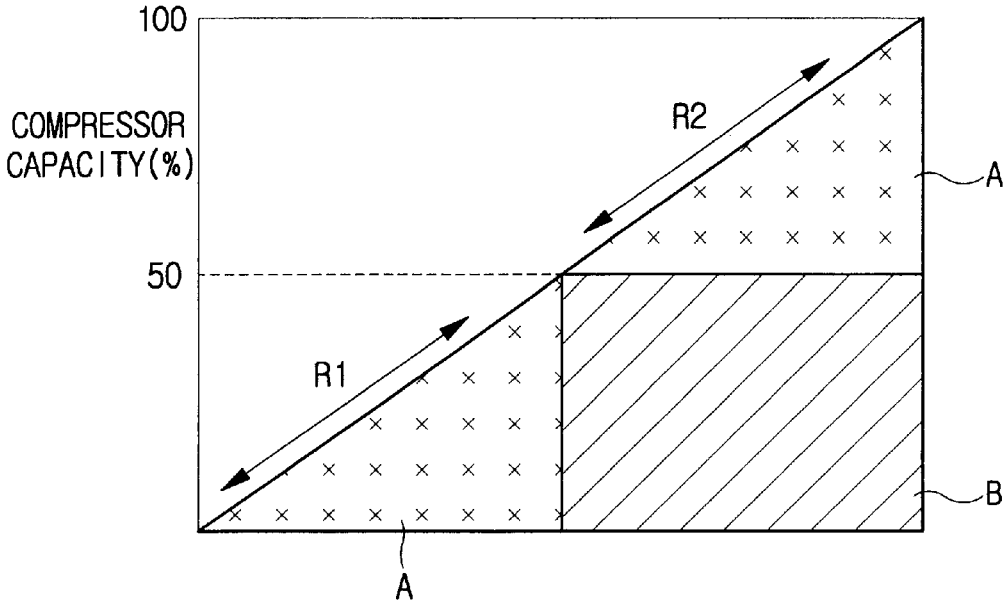
FIG. 2 (PRIOR ART)
FIG. 2 is a graph showing an operation of controlling capacities of the compressors of FIG. 1.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
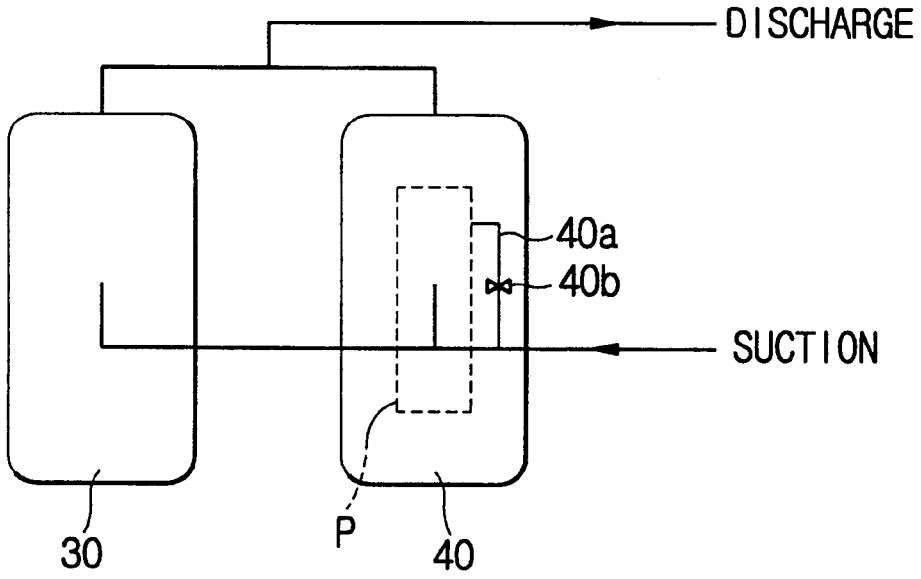
FIG. 3 is a view showing a construction of an air conditioning apparatus in which a pulse width modulation compressor and a two-stage variable-capacity compressor are connected in parallel with each other according to an embodiment of the present invention.

FIG. 3 is a view showing a construction in which a pulse width modulation compressor and a two-stage variable-capacity compressor are connected in parallel with each other according to an embodiment of the present invention.

Figure 7:
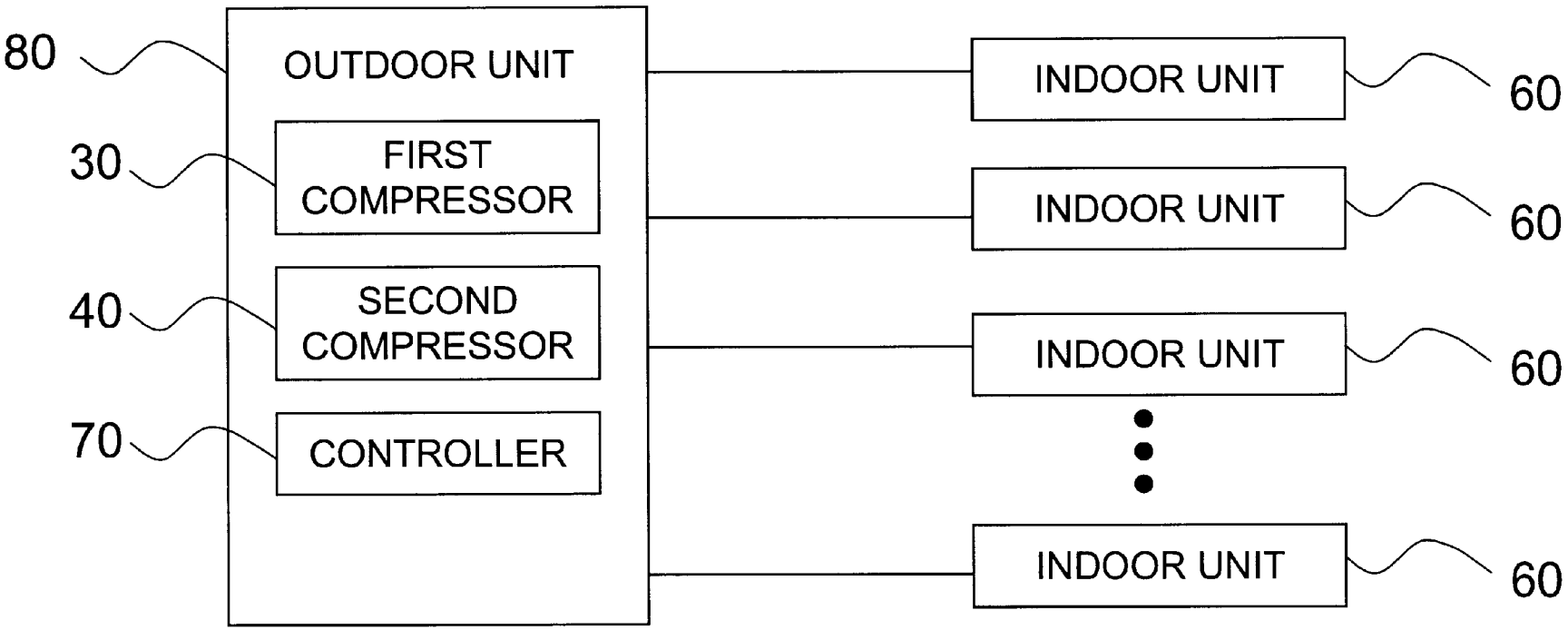
FIG. 7 is a block diagram showing a multi-unit air conditioning according to the embodiment of the present invention.

As shown in FIG. 3, the air conditioning apparatus comprises two compressors 30 and 40 connected in parallel with each other. The compressors 30 and 40 can be applied to a multi-unit air conditioning apparatus, as shown in FIG. 7, in which a plurality of indoor units 60 are connected to one outdoor unit 80. In this case, the compressors 30 and 40 are installed in the outdoor unit 80, and capacities of the compressors 30 and 40 are under control of an outdoor unit controller 70 (i.e., a microcomputer).

A capacity of the first compressor 30 is controlled in response to a duty control signal outputted from a pulse width modulation circuit (not shown) under control of the outdoor unit controller 70. That is, the outdoor unit controller 70 calculates an indoor air conditioning load (required capacity) by communicating with respective indoor units 60 and controls the capacities of the compressors according to the calculated indoor air conditioning load. In this case, the first compressor 30 is a pulse width modulation compressor whose capacity is controlled by modulating pulse widths corresponding to a loading operation (discharging refrigerant) and an unloading operation (not discharging refrigerant) within a given cycle according to a capacity of a compressor 30 controlled, and controlling a pulse width modulation (PWM) valve of the compressor 30 using the pulse width modulated duty control signal.

The second compressor 40 is a two-stage variable-capacity compressor which has a compressing room P, a bypass tube 40*a* connecting one side of the compressing room P with a suction side, and a valve 40*b* disposed in a middle of the bypass tube 40*a*. If the valve 40*b* is closed according to a control instruction of the outdoor unit controller 70, the compressing room P performs a compression of all refrigerant, so the second compressor 40 is operated at 100% capacity, which is a maximum capacity. Alternatively, if the valve 40*b* is opened according to a control instruction of the outdoor unit controller 70, a part of the refrigerant is leaked out through the suction side, so the second compressor 40 is operated at 50% capacity, which is a minimum capacity.

As described above, the second compressor 40 operates at one of a minimum capacity or a maximum capacity, which are two different capacities, determined by the outdoor unit controller 70. It is further understood that additional compressors can be added to add more capacities as needed, which operates with a total capacity characteristic which is linear.

A maximum capacity of the first compressor 30 is equal to the minimum capacity of the second compressor 40, and corresponds to a half of the maximum capacity of the second compressor 40. The capacity of the first compressor 30 is set relatively low to reduce the manufacturing cost as much as possible because a variable-capacity compressor is expensive relative to a fixed-capacity compressor, and a typical compressor becomes more expensive as a maximum capacity of the compressor becomes larger.

A device to keep oil supplied to the first and second compressors 30 and 40 with different capacities may be provided. An oil equalization tube B may be employed, as shown in FIG. 4.

Figure 4:
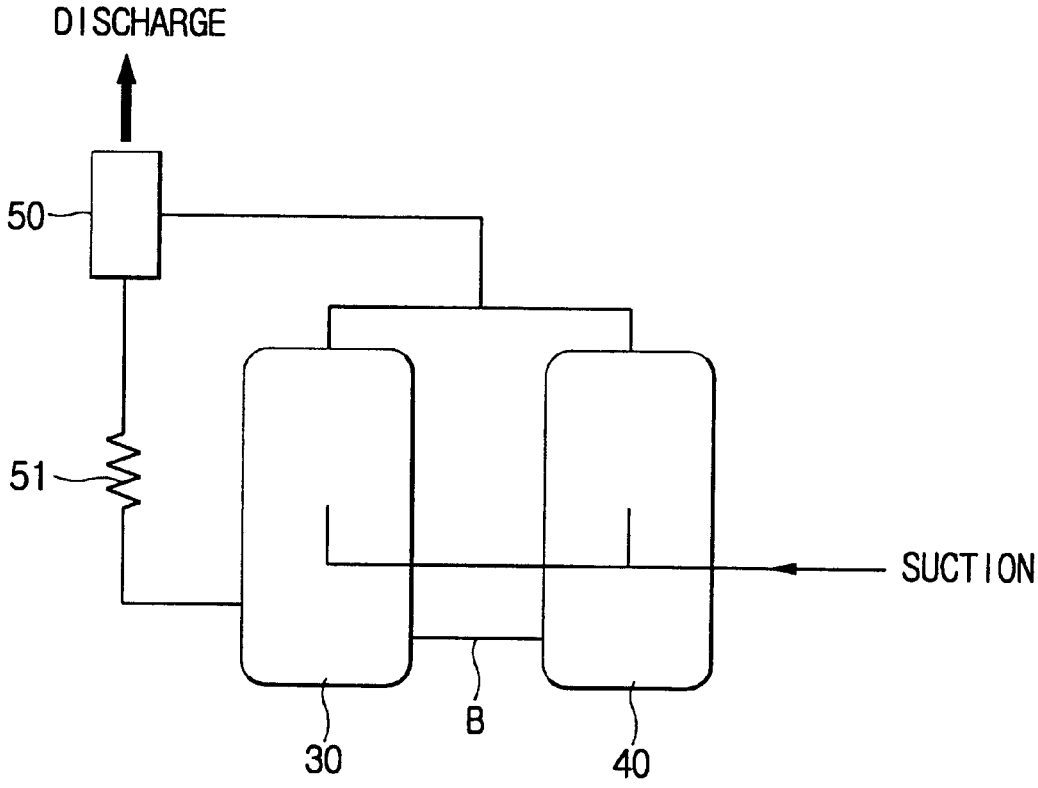
FIG. 4 is a view showing a construction in which an oil equalization tube is connected to the compressors according to the embodiment of the present invention.

As shown in FIG. 4, an oil separator 50 is arranged in discharge sides of the first and second compressors 30 and 40 to separate refrigerant and oil. A capillary tube 51 is disposed between the first compressor 30 and the oil separator 50. Further, the oil equalization tube B is disposed between the first and second compressors 30 and 40 to connect an oil storing room of the first compressor 30 with an oil storing room of the second compressor 40.

Oil separated from the refrigerant by the oil separator 50 returns to the first compressor 30 through the oil equalization tube B. In this case, an additional oil equalizing operation is not performed.

Hereinafter, the operation of the air conditioning apparatus and control method thereof according to the present invention is described in detail with reference to FIGS. 5 and 6.

The air conditioning apparatus is applied to a multi-unit air conditioning apparatus in which an indoor air conditioning load may be highly varied. In this case, the multi-unit air conditioning apparatus is described, in which a plurality of indoor units 60 are connected to one outdoor unit 80, the indoor units 60 and the outdoor unit 80 mutually communicate with each other, and an outdoor unit controller 70 to control several compressors installed in the outdoor unit controls capacities of the compressors according to indoor air conditioning loads (required capacities) received from respective indoor units 60.

First, the outdoor unit controller 70 calculates a total indoor air conditioning load (required capacity) by summing up the air conditioning loads received from corresponding indoor units 60 of the plural indoor units 60 at operation S110.

Then, the outdoor unit controller 70 determines whether the calculated total required capacity is 0 at operation S120. If the total required capacity is 0, the outdoor unit controller 70 stops operations of both the first and second compressors 30 and 40 at operation S130.

If the total required capacity is not 0 at operation S120, the outdoor unit controller 70 determines whether the total required capacity is equal to or less than 33% of a total capacity of the compressors 30, 40 at operation S140. If the total required capacity is equal to or less than 33% of the total capacity of the compressors, the microcomputer stops an operation of the second compressor 40, and controls the capacity of the first compressor 30 to correspond to the calculated total required capacity by applying a duty control signal to the first compressor through a pulse width modulation circuit and thereby controlling the PWM valve of the first compressor 30 to be opened (in an unloading operation of not discharging refrigerant) or closed (in a loading operation of discharging refrigerant) in response to the duty control signal, as shown in P11 of FIG. 5, at operations S150, S160 and S170.

If the total required capacity is more than 33% of the total capacity of the compressors 30, 40 at operation S140, the outdoor unit controller 70 determines whether the total required capacity is equal to or less than 67% of the total capacity of the compressors at operation S180. If the total required capacity is equal to or less than 67% of the total capacity of the compressors, the outdoor unit controller 70 opens the valve 40*b* so as to allow the second compressor 40 to operate at a minimum capacity (with reference to B of FIG. 5), and controls the capacity of the first compressor 30 to correspond to the calculated total required capacity by applying a duty control signal to the first compressor through the pulse width modulation circuit and thereby controlling the PWM valve of the first compressor 30 to be opened or closed in response to the duty control signal, as shown in P12 of FIG. 5, at operations S190, S200 and S210.

Figure 5:
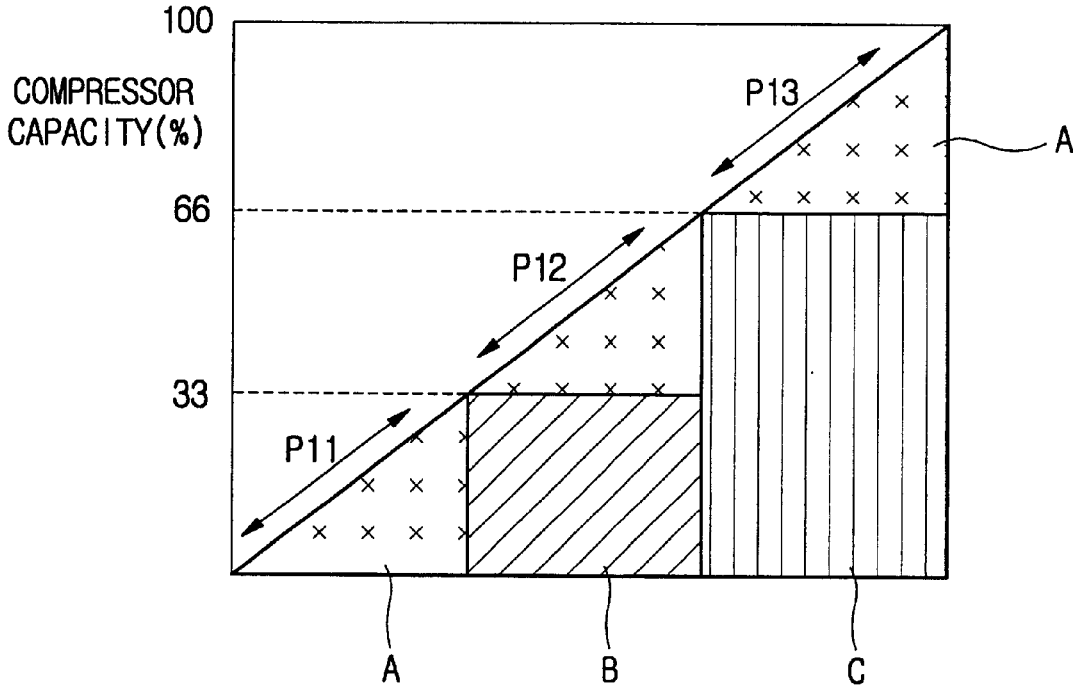
FIG. 5 is a graph showing an operation of controlling capacities of the compressors according to the embodiment of the present invention.
Figure 6:
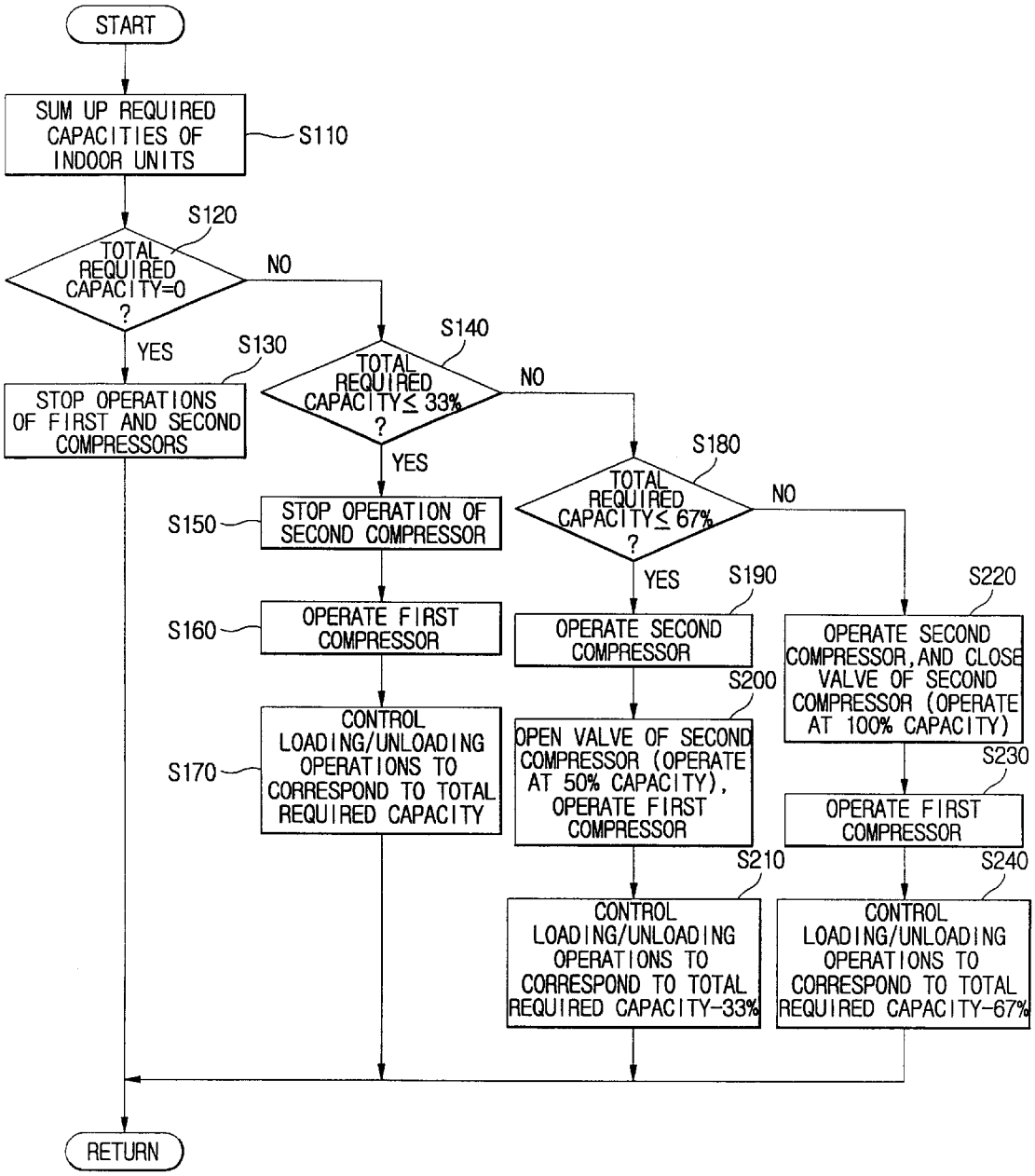
FIG. 6 is a flowchart of a method of controlling the air conditioning apparatus according to the embodiment of the present invention.

If the total required capacity is more than 67% of the total capacity of the compressors 30, 40 at operation S180, the outdoor unit controller 70 closes the valve 40*b* so as to allow the second compressor 40 to operate at the maximum capacity (with reference to C of FIG. 5) and controls the capacity of the first compressor 30 to correspond to the calculated total required capacity by applying a duty control signal to the first compressor through the pulse width modulation circuit and thereby controlling the PWM valve of the first compressor 30 to be opened or closed in response to the duty control signal, as shown in P13 of FIG. 5, at operations S220, S230 and S240.

After the operations S130, S170, S210 and S240 are performed, processing returns to the starting operation.

As described above, an air conditioning apparatus and control method thereof is provided, in which a pulse width modulation variable-capacity compressor and a two-stage variable-capacity compressor are connected in parallel with each other, thus enabling the capacities of the compressors to be controlled in correspondence with the indoor air conditioning loads (required capacities). Further, the air conditioner is advantageous in that the air conditioner is cost-competitive because a capacity supplied by the pulse width modulation compressor is relatively low, and the cost required for manufacturing the pulse width modulation compressor is reduced in proportion to the reduced capacity requirements. It is understood that additional compressors can be used, and that the micro controller can be a computer implementing the control method which is programmed on a computer readable medium or in firmware.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An air conditioning apparatus, comprising:

a first compressor controlled in a pulse width modulation manner;

a second compressor connected in parallel with the first compressor and controlled to operate at one of a non-zero minimum capacity and a maximum capacity; and a control unit to control capacities of the first and second compressors such that a total capacity of the first and second compressors is linearly controlled according to indoor air conditioning loads.

2. The air conditioning apparatus according to claim 1, wherein the control unit controls a capacity of the first compressor using to a duty control signal to control a cycle for loading and unloading operations, a maximum capacity of the first compressor is equal to the minimum capacity of the second compressor, and the maximum capacity of the second compressor is at or greater than about twice the minimum capacity of the second compressor.

3. The air conditioning apparatus according to claim 1, wherein the second compressor includes a bypass tube to bypass refrigerant to a suction side and a valve disposed in a middle of the bypass tube, and the second compressor operates such that if the valve is closed, all refrigerant flows through a discharge side so that the second compressor operates at the maximum capacity, and if the valve is opened, a part of the refrigerant flows through the suction side so that the second compressor operates at the minimum capacity.

4. The air conditioning apparatus according to claim 1, further comprising:

an oil equalization tube to connect the first compressor with the second compressor so as to keep oil supplied to the first and second compressors in suitable states.

5. An air conditioning apparatus, comprising:

a plurality of indoor units; and an outdoor unit connected to the plurality of indoor units, comprising, a first compressor controlled in a pulse width modulation manner;

a second compressor connected in parallel with the first compressor and controlled to operate at one of a non-zero minimum capacity and a maximum capacity, and an outdoor control unit to control the capacities of the first and second compressors such that a total capacity of the first and second compressors is linearly controlled according to indoor air conditioning loads required by the indoor units.

6. A method of controlling an air conditioning apparatus, the air conditioning apparatus having a plurality of indoor units connected to an outdoor unit comprising a first compressor controlling a capacity of the first compressor in a pulse width modulation manner and a second compressor operating at one of a minimum capacity and a maximum capacity, comprising:

calculating an air conditioning capacity required by corresponding indoor units; and controlling capacities of the first and second compressors such that a total capacity of the first and second compressors is linearly controlled according to the calculated air conditioning capacity, wherein a maximum capacity of the first compressor is equal to the minimum capacity of the second compressor, and the maximum capacity of the second compressor is at or greater than about twice the minimum capacity of the second compressor.

7. The control method of the air conditioning apparatus, according to claim 6, wherein the controlling comprises:

stopping operations of the first and second compressors, if the calculated air conditioning capacity is 0;

stopping an operation of the second compressor and controlling the capacity of the first compressor by determining a duty control signal corresponding to the calculated air conditioning capacity and performing loading and unloading operations in response to the duty control signal, if the required air conditioning capacity is greater than 0 and is less than or equal to the maximum capacity of the first compressor;

allowing the second compressor to operate at the minimum capacity and controlling the capacity of the first compressor by determining the duty control signal corresponding to the calculated air conditioning capacity and performing the loading and unloading operations in response to the duty control signal, if the calculated air conditioning capacity is greater than the maximum capacity of the first compressor and is less than or equal to the maximum capacity of the second compressor; and allowing the second compressor to operate at the maximum capacity and controlling the capacity of the first compressor by determining the duty control signal corresponding to the calculated air conditioning capacity and performing the loading and unloading operations in response to the duty control signal, if the calculated air conditioning capacity is greater than the maximum capacity of the second compressor.

8. An air conditioning apparatus, comprising:

a first compressor controlled using pulse width modulation;

a second compressor connected in parallel with the first compressor and operated at different non-zero capacities; and a control unit controlling capacities of the first and second compressors such that a total capacity of the first and second compressors is varied according to indoor air conditioning loads.

9. The air conditioning apparatus according to claim 8, wherein the control unit controls a capacity of the first compressor and a maximum capacity of the first compressor is substantially equal to a minimum one of the capacities of the second compressor, and a maximum one of the capacities of the second compressor being at or more than two times the minimum capacity of the second compressor.

10. The air conditioning apparatus according to claim 8, wherein the control unit controls the capacity of the first compressor using to a duty control signal controlling a cycle for loading and unloading operations.

11. The air conditioning apparatus according to claim 8, wherein the second compressor includes a bypass tube bypassing refrigerant to a suction side and a valve disposed in a middle of the bypass tube, and the second compressor operates such that if the valve is closed, all the refrigerant flows through a discharge side of the second compressor, so the second compressor operates at one of the capacities capacity, and if the valve is opened, a part of the refrigerant flows through the suction side of the second compressor, so the second compressor operates another one of the capacities.

12. The air conditioning apparatus according to claim 8, further comprising:

an oil equalization connecting the first compressor with the second compressor so as to supply oil to the first and second compressors according to the indoor air conditioning loads.

13. An air conditioning apparatus, comprising:

a plurality of indoor units; and an outdoor unit connected to the plurality of indoor units, comprising, a variable-capacity compressor controlled using in pulse width modulation, a two-level compressor connected in parallel with the variable-capacity compressor and controlled to operate at one of a non-zero first capacity and a non-zero second capacity, and an outdoor control unit to control the capacities of the variable-capacity compressor and the two-level compressor such that a total capacity of the variable-capacity compressor and the two-level compressor is controlled by setting the capacity of the two-level compressor at one of the first capacity and the second capacity and varying the variable-capacity compressor using a duty control signal controlling a cycle for loading and unloading operations.

14. The air conditioning apparatus according to claim 13, wherein a maximum capacity of the variable-capacity compressor is equal to the first capacity of the two-level compressor, and the second capacity of the two-level compressor is two times or more the first capacity of the two-level compressor.

15. A method of controlling an air conditioning apparatus, the air conditioning apparatus having a plurality of indoor units connected to an outdoor unit comprising a first compressor controlling a capacity of the first compressor using pulse width modulation and a second compressor operating at one of a first capacity and a second capacity, a maximum capacity of the first compressor is equal to the first capacity of the second compressor, and the second capacity of the second compressor is two times or more the first capacity of the second compressor, the method comprising:

calculating an air conditioning capacity according to indoor air conditioning loads; and controlling capacities of the first and second compressors such that a total capacity of the first and second compressors is varied according to the calculated air conditioning capacity by setting a capacity of the second compressor to one of the first capacity and the second capacity, and varying by pulse width modulating the capacity of the first compressor.

16. The control method of the air conditioning apparatus according to claim 15, wherein controlling capacities further comprises:

stopping operations of the first and second compressors, if the calculated air conditioning capacity is 0;

stopping an operation of the second compressor and controlling the capacity of the first compressor by determining a duty control signal corresponding to the calculated air conditioning capacity and performing loading and unloading operations in response to the duty control signal, if the calculated air conditioning capacity is greater than 0 and is less than or equal to the maximum capacity of the first compressor;

allowing the second compressor to operate at the first capacity and controlling the capacity of the first compressor by determining the duty control signal corresponding to the calculated air conditioning capacity and performing the loading and unloading operations in response to the duty control signal, if the calculated air conditioning capacity is greater than the maximum capacity of the first compressor and is less than or equal to the second capacity of the second compressor; and allowing the second compressor to operate at the second capacity and controlling the capacity of the first compressor by determining the duty control signal corresponding to the calculated air conditioning capacity and performing the loading and unloading operations in response to the duty control signal, if the calculated air conditioning capacity is greater than the second capacity of the second compressor.

17. The control method of the air conditioning apparatus according to claim 15, wherein controlling capacities further comprises:

operating the first and second compressors at the calculated air conditioning capacity by setting the capacity of the second compressor to operate at a higher capacity of the first capacity of the second compressor and the second capacity of the second compressor, while not exceeding the calculated air conditioning capacity, and by adjusting the capacity of the first compressor to operate at a capacity equal to a difference between the calculated air conditioning capacity and the capacity set for the second compressor.

18. The control method of the air conditioning apparatus according to claim 15, wherein controlling capacities further comprises:

setting the capacity of the second compressor to operate at a higher capacity of the first capacity of the second compressor and the second capacity of the second compressor, not exceeding the calculated air conditioning capacity; and adjusting the capacity of the first compressor to operate at a capacity substantially equal to a difference between the calculated air conditioning capacity and the capacity of the second compressor in said setting.

19. An air conditioning apparatus having a first compressor and a second compressor and a control unit, wherein:

the first compressor is controlled using pulse width modulation;

the second compressor is connected in parallel with the first compressor and is operated at one of a non-zero first capacity and a non-zero second capacity; and the control unit controls capacities of the first and second compressors and varies a total capacity of the first and second compressors according to indoor air conditioning loads.

20. A controller for controlling an air conditioning apparatus having a first compressor and a second compressor, comprising:

a control unit controlling the first compressor using pulse width modulation and the second compressor, which is connected in parallel with the first compressor and operated at different non-zero capacities, and the control unit controls the first and second compressors by varying the capacities of the first and second compressors such that a total capacity of the first and second compressors is varied according to indoor air conditioning loads.

21. A machine readable storage medium for controlling a computer to operate an air conditioning apparatus having a plurality of indoor units connected to an outdoor unit comprising a first compressor operating using pulse width modulation, and a second compressor operating at one of a first capacity and a second capacity, a maximum capacity of the first compressor being substantially equal to a minimum one of the capacities of the second compressor, and a maximum one of the capacities of the second compressor being at or more than two times the minimum capacity of the second compressor, the machine readable storage medium storing a program to execute:

calculating an air conditioning capacity according to indoor air conditioning loads; and controlling capacities of the first and second compressors such that a total capacity of the first and second compressors is varied according to the calculated air conditioning capacity by setting a capacity of the second compressor to one of the first capacity and the second capacity, and varying by pulse width modulating the capacity of the first compressor.

22. An air conditioning apparatus, comprising:

at least three or more compressors connected in parallel, one of the at least three or more compressors controlled using pulse width modulation, and the remaining compressors operated at different non-zero capacities; and a control unit controlling capacities of the first and second compressors such that a total capacity of the at least three or more compressors is linearly varied according to indoor air conditioning loads.

* * * * *